US007786412B2

(12) United States Patent
Borchardt

(10) Patent No.: US 7,786,412 B2
(45) Date of Patent: Aug. 31, 2010

(54) PRESSURE RELIEF FOR CURRENT LIMITER

(75) Inventor: Glenn R. Borchardt, Round Lake Beach, IL (US)

(73) Assignee: S&C Electric Company, Chicago, IL (US)

( * ) Notice: Subject to any disclaimer, the term of this patent is extended or adjusted under 35 U.S.C. 154(b) by 1116 days.

(21) Appl. No.: 11/211,254

(22) Filed: Aug. 25, 2005

(65) Prior Publication Data

US 2006/0044740 A1 Mar. 2, 2006

Related U.S. Application Data

(63) Continuation of application No. PCT/US2004/008017, filed on Mar. 18, 2004.

(60) Provisional application No. 60/457,245, filed on Mar. 25, 2003.

(51) Int. Cl.
*H05B 1/02* (2006.01)

(52) U.S. Cl. ..... 219/485; 219/517; 219/491; 219/494; 337/158; 337/180

(58) Field of Classification Search ..... 219/485, 219/490, 491, 494, 504, 505, 517, 522; 337/168–181, 337/159, 228–231
See application file for complete search history.

(56) References Cited

U.S. PATENT DOCUMENTS

| | | | | | |
|---|---|---|---|---|---|
| 2,091,453 | A | * | 8/1937 | Ramsey | 337/240 |
| 2,183,751 | A | * | 12/1939 | McMahon et al. | 337/240 |
| 2,549,635 | A | * | 4/1951 | Pittman | 337/171 |
| 2,917,605 | A | * | 12/1959 | Fahnoe | 337/159 |
| 4,313,100 | A | * | 1/1982 | Schmunk | 337/168 |
| 5,235,307 | A | | 8/1993 | Oh | |

* cited by examiner

*Primary Examiner*—Mark H Paschall

(57) ABSTRACT

A current-limiting device is provided with pressure relief facilities that are responsive to relieve internal pressures during operation of the current limiter. In a specific arrangement, the pressure relief arrangement includes a passage that is opened upon operation of the current limiter to communicate between the interior and the exterior of the current limiter. The passage includes a fusible material therein that is melted by the heating within current limiter under predetermined high-current fault conditions. In a specific arrangement, the passage is formed through a contact terminal of the current limiter. In one arrangement, the current-limiting device includes an adjoining exhaust section and the contact terminal extends into the adjoining exhaust section.

2 Claims, 2 Drawing Sheets

PRESSURE RELIEF FOR CURRENT LIMITER

This application is a continuation of Application No. PCT/US2004/008017 filed on Mar. 18, 2004 which is a continuation of and claims the benefit of U.S. Provisional Application No. 60/457,245 filed Mar. 25, 2003.

BACKGROUND OF THE INVENTION

1. Field of the Invention

The present invention relates generally to the field of current-limiting fuses for electrical power distribution systems and more particularly to an improved current limiter that provides pressure relief of internal pressures during operation of the current limiter.

2. Description of Related Art

Various current-limiting fuse arrangements are known in the prior art, e.g. see U.S. Pat. Nos. 5,604,475 and 5,502,427.

While the prior art arrangements may be generally useful as current-limiting devices for the electrical distribution field, it is desirable to provide a current limiter with pressure relief provisions.

SUMMARY OF THE INVENTION

Accordingly, it is a principal object of the present invention to provide a current limiter that provides pressure relief of internal pressures during operation of the current limiter.

These and other objects of the present invention are efficiently achieved by a current-limiting device having pressure relief facilities that are responsive to relieve internal pressures during operation of the current limiter. In a specific arrangement, the pressure relief arrangement includes a passage that is opened upon operation of the current limiter to communicate between the interior and the exterior of the current limiter. The passage includes a fusible material therein that is melted by the heating within current limiter under predetermined high-current fault conditions. In a specific arrangement, the passage is formed through a contact terminal of the current limiter. In one arrangement, the current-limiting device includes an adjoining exhaust section and the contact terminal extends into the adjoining exhaust section.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 3:
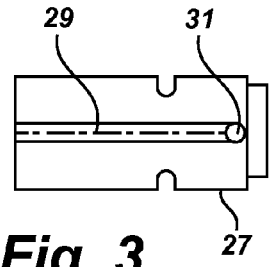
FIGS. 3-5 are respective front, bottom and right-hand elevational views of a contact terminal of the current limiter of FIGS. 1 and 2.
Figure 4:
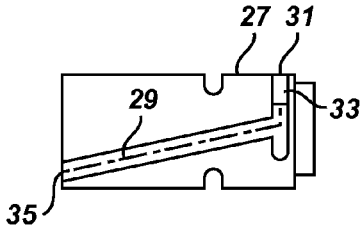
Figure 5:
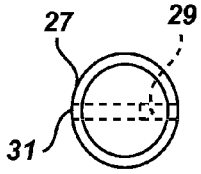
Figure 1:
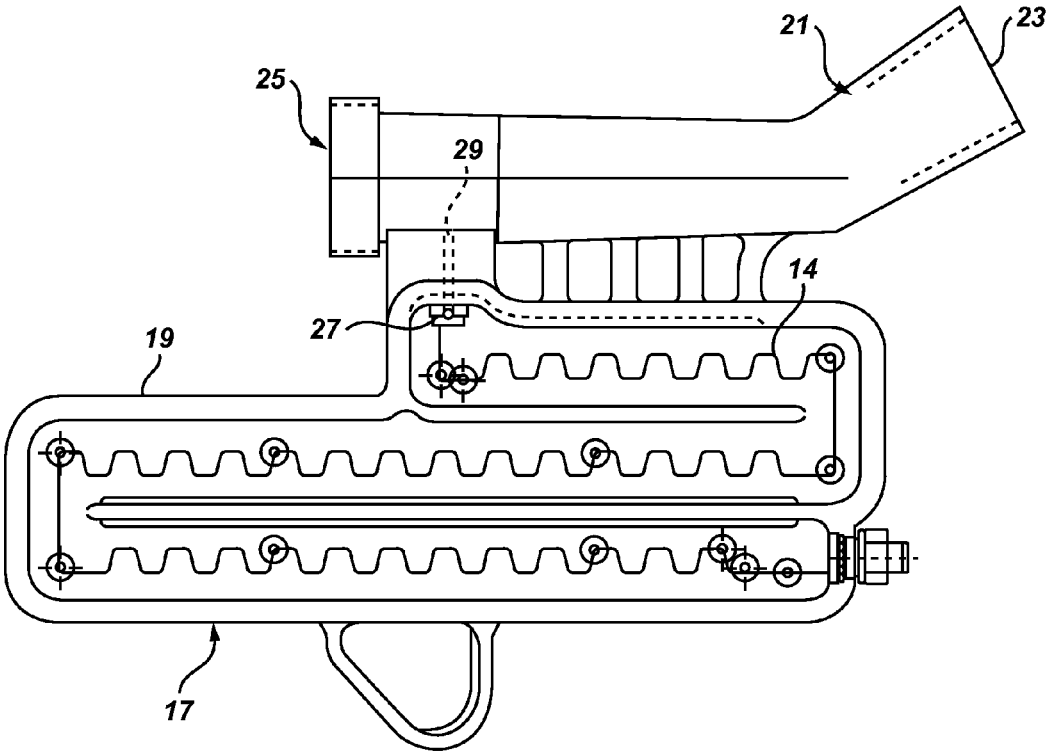
FIG. 1 is an elevational view of the current limiter of the present invention with parts removed for clarity.
Figure 2:
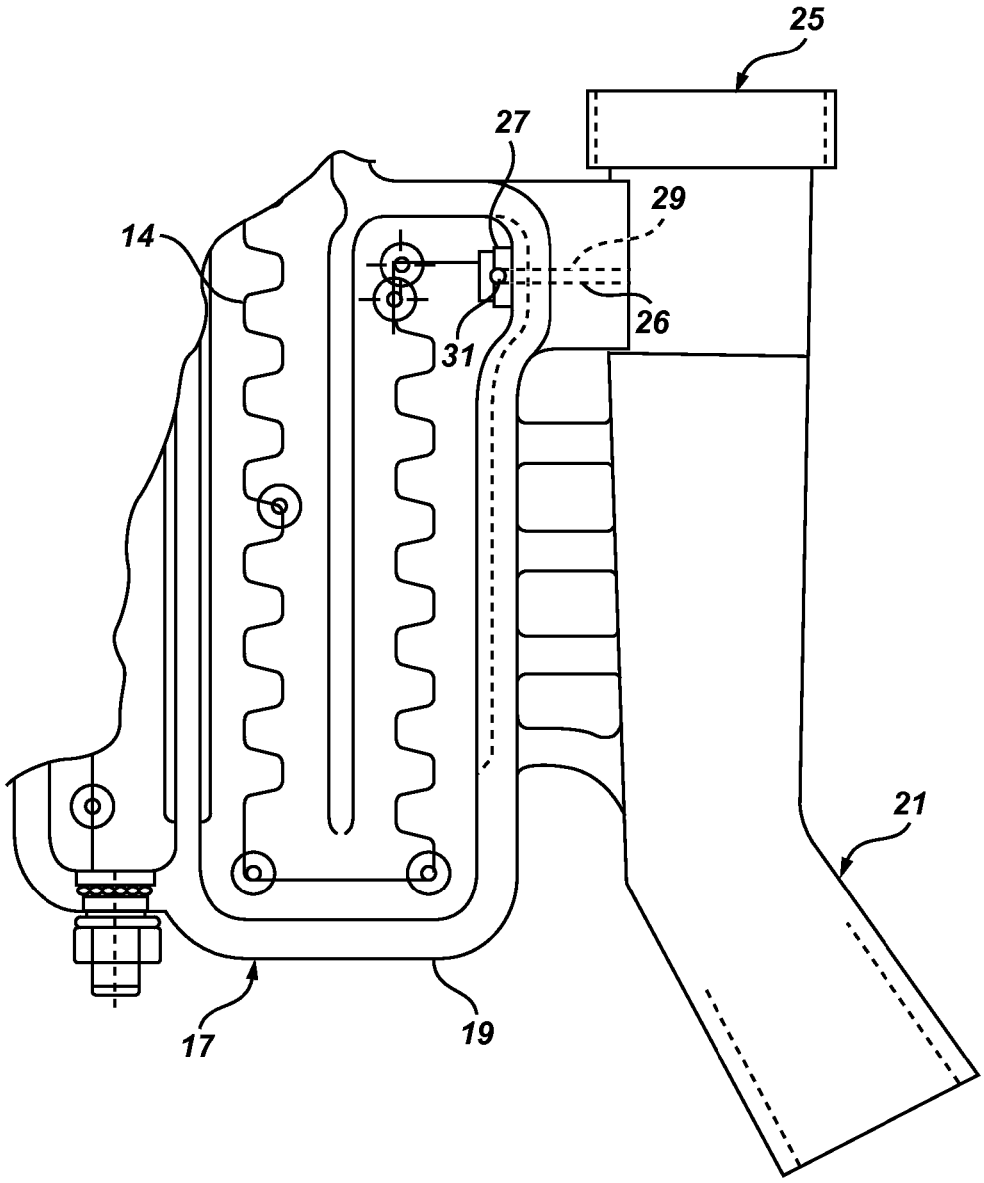
FIG. 2 is a partial, enlarged view of the current limiter of FIG. 1.

In an illustrative embodiment of the present invention and with reference to FIGS. 1-5, a limiter 17 in accordance with the present invention and of the general type as shown in U.S. Pat. Nos. 5,604,475 and 5,502,427, includes pressure relief provisions to relieve the internal pressure of the limiter 17 during operation thereof. The limiter 17 includes a fusible element 14 positioned about a predetermined circuitous path through a housing 19 of the limiter 17. In the illustrative embodiment, the limiter 17 includes an exhaust/venting section 21 with controlled exhaust at 23 formed integrally as part of the limiter 17. As shown in U.S. Pat. No. 5,502,427, the exhaust/venting section 21 interfits with a fuse tube assembly (not shown) at 25 to form a low-current section of an overall fuse limiter. The low-current section is electrically connected in series with the limiter 17 via a contact terminal 27 best seen in FIGS. 2-5. However, this should not be interpreted in any limiting sense since the present invention may be practiced without an integral exhaust/venting section 21, e.g. as shown in U.S. Pat. No. 5,604,475. During current-limiting operation at high-current fault conditions, high internal pressures and temperatures are developed within the limiter 17 which is sealed from the exterior environment.

In accordance with important aspects of the present invention, to improve the withstand of the limiter 17 during high-current fault conditions, internal pressure relief is provided at 26 for the limiter 17 via venting to the exterior of the limiter 17, e.g. via provisions providing a passage at 29 through the contact terminal 27 in the illustrative embodiment that are operative in response to high-temperature conditions within the limiter 17. In a specific illustrative embodiment, a passage 31 in the portion of the contact terminal 27 within the interior of the limiter 17 communicates with the passage 29 that continues through the contact terminal 27 to the interior of the exhaust/venting section 21. Fusible material at 33 is provided within the passage 31 such that under normal conditions the communication through passages 31 and 29 are sealed to the exhaust/venting section 21. When the limiter 17 operates under high-current fault conditions, the terminal 27 is heated and the fusible material at 33 is melted and the internal pressures are vented into the exhaust/venting section 21 and out to the external environment. In a specific embodiment, the fusible material at 33 is a low melting-point solder. Thus, with the pressure relief provisions at 26, the present invention provides increased withstand of the limiter 17 to high-current fault conditions to achieve either higher ratings or reduced requirements on the housing 19.

In a specific embodiment, the passage 29 is arranged in a predetermined configuration through the contact terminal 27, e.g. sloped from one end to the other so as to appropriately interface with a contact (not shown) of the fuse tube assembly of U.S. Pat. No. 5,502,427 as discussed hereinbefore. In this manner, the opening 35 of the passage 29 at the exterior end of the contact terminal 27 does not interfere with a preferred contact area at this exterior end of the contact terminal.

While there have been illustrated and described various embodiments of the present invention, it will be apparent that various changes and modifications will occur to those skilled in the art. Accordingly, it is intended in the appended claims to cover all such changes and modifications that fall within the true spirit and scope of the present invention.

The invention claimed is:

1. In a current-limiting device that develops internal heat and pressure during operation thereof, the improvement comprising a pressure relief arrangement to communicate the interior of the current-limiting device to the exterior thereof when predetermined high-current fault conditions are experienced, and a contact terminal for electrical connection between the interior and the exterior of the current-limiting device, the pressure relief arrangement comprising a passage formed through the contact terminal and a fusible material disposed within the passage.

2. The current-limiting device of claim 1 further including an adjoining exhaust section and wherein the contact terminal extends into the adjoining exhaust section.

* * * * *